United States Patent [19]

Chambers

BEST AVAILABLE COPY

[11] 4,046,324

[45] Sept. 6, 1977

[54] SOLID WASTE COMMINUTOR

[76] Inventor: Joseph W. Chambers, P. O. Box 2449, Huntington Beach, Calif. 92647

[21] Appl. No.: 655,094

[22] Filed: Feb. 4, 1976

Related U.S. Application Data

[63] Continuation-in-part of Ser. No. 372,818, June 22, 1973.

[51] Int. Cl.[2] ..... B02C 13/06; B02C 23/36

[52] U.S. Cl. ..... 241/46.06; 241/236

[58] Field of Search ..... 241/46.06, 46.08, 46.11, 241/46.17, 227, 235, 236

[56] References Cited

U.S. PATENT DOCUMENTS

| | | | |
|---|---|---|---|
| 1,477,502 | 12/1923 | Killick | 241/236 |
| 3,151,645 | 10/1964 | Hesse | 241/236 X |
| 3,529,782 | 9/1970 | Liebman | 241/236 X |
| 3,664,592 | 5/1972 | Schweigert et al. | 241/236 UX |
| 3,695,520 | 10/1972 | Mauro | 241/46.11 X |
| 3,738,582 | 6/1973 | Neidl | 241/46.11 |

*Primary Examiner*—Roy Lake
*Assistant Examiner*—Howard N. Goldberg
*Attorney, Agent, or Firm*—Fulwider, Patton, Rieber, Lee & Utecht

[57] ABSTRACT

An apparatus for shredding, crushing and grinding solid waste material for eventual waste disposal in which two interacting stacks of shredding members are mounted on substantially parallel shafts and are positioned in transverse arrangement with respect to the direction of waste material introduction into the comminutor apparatus. A shredding member of each stack interacts with a shredding member on the other stack whereby the shredding members cooperatively interact in pairs within the comminutor. In some applications, the minimum clearance distance between the teeth of a cutting element with an opposing spacer in a pair of interacting shredding members differs as between different ones of the pairs of interacting shredding members. Teeth are provided on at least one member of each pair of shredding members for cutting in both directions of rotation. The shaft of one of the stacks is driven through a gear reduction system in order to reduce noise and power requirements for operation. The shaft may be driven in either direction of rotation so that the teeth of the shredding members may be driven to cut in either direction.

10 Claims, 2 Drawing Figures

SOLID WASTE COMMINUTOR

CROSS REFERENCE TO RELATED APPLICATION

The present application is a continuation-in-part of U.S. Ser. No. 372,818, filed June 22, 1973 and entitled Sewage Waste Device. The benefit of the earlier filing date is claimed for the subject matter common to both applications.

BACKGROUND OF THE INVENTION

The present invention relates to an improved form of solid waste comminuting apparatus. Comminution, or the reduction of particle size of solid waste material to minute particles, is performed by shearing, shredding and crushing of the waste material. Comminution may be performed by feeding the solid waste material into the interface of counter-rotating intermeshed cutting members. Shearing action occurs when the particles of waste material are clipped or cut by the "scissors" action between cutters on one shaft and those on the other shaft due to overlap of root diameters of cutters. The solid particles are thereby sheared by the opposing forces of counter-rotation of the cutting elements on the different stacks of cutting elements. The particles are also shredded by the tearing action of the leading edge of a cutting element against solid material trapped between that cutting element and the opposite stack. The movement of the cutting element past the trapped solid material also serves to crush the waste material.

Comminution may be performed whether or not the solid material is entrained in a liquid that is fed to the comminuter. Such entrainment is frequently a convenient means of transporting the solid material to the comminuter, and has the further advantage in that comminution is thereby aided by the process of maceration, which is the softening and wearing effect a liquid medium has on solid particles entrained therein. It should be noted, however, that comminution may be performed whether or not the solid material is entrained in a liquid medium. Utilization of a comminutor significantly aids in the disposal or deactiviation of solid materials such as raw sewage, sludge and skimmings.

SUMMARY OF THE INVENTION

It is an object of the present invention to provide a comminuting apparatus of improved durability. In conventional systems, counter-rotation of stacks of cutting elements is performed in but a single direction of relative rotation. That is, the teeth of the cutting elements are effective only for a single direction of rotation. The design of the present invention allows the teeth of the cutting elements to perform their comminuting function when rotated in both directions, thereby providing increased flexibility and a greater length of cutting surface without an increase in the dimensions of the comminuter.

A further object of the invention is to reduce the noise level of operation and the power requirements necessary to comminute solid waste material to be processed. These advantages are realized by reducing the speed of rotation of the cutting elements below the speed of the power source by a factor of at least 30 to 1. While in many applications, such as in the processing of sewage waste, there is an uniform design clearance between the teeth of the cutting elements and their respective opposing spacer elements in the counter-rotating stacks. In other applications, such as in knocking down cardboard boxes where shredding is the principal form of comminution it may be desirable to provide pairs of interacting shredding members in which different minimum clearances are provided between the teeth and an interacting spacer member as between different ones of the pairs of interacting shredding members. The advantage of this arrangement is a significant saving of power in the operation of the comminutor due to proper selection of size and spacing of cutter teeth. Some materials, such as cardboard, for example, are difficult to shred. The relatively short cutter teeth perform the shredding action of merely knocking down the cardboard with a relatively small power requirement. Other teeth may be longer to provide a smaller clearance between the end of the teeth and the interacting spacers to shred the material more effectively.

In a broad aspect, the invention may be considered to be an apparatus for comminuting solid waste material including: a casing defining therein a comminution chamber, with inlet and outlet ports thereto disposed on opposing sides of the comminution chamber and adapted for connection in a solid waste disposal line, which may be an open channel, in which case the ports are merely inlets and outlets to the comminutor. In such embodiments, the comminution chamber is left open to the flow of media which includes inlets and outlets as ports. A comminutor assembly is provided and includes cooperating substantially parallel first and second shredding stacks located in said comminution chamber and respectively having a plurality of first concentric laminar cutting elements mounted on a first shaft in interspaced relationship with a plurality of second laminar cutting elements mounted concentrically on a second shaft, each cutting element having teeth shaped for cutting in both of two opposite directions of rotation and wherein the cutting elements of each stack are positioned between and separated in an axial direction by laminar spacers which are coplanar with cutting elements of the other stack, whereby a cutting element from one shredder and a spacer from the other shredder form a pair of interactive shredding members, and wherein said first and second stacks are compressed between first and second distally opposed bearing plates which receive said first and second shafts, said bearing plates being secured to said casing in compression against said stacks; means for securing said first and second bearing plates to said casing; gearing means disposed on adjacent ends of said first and second shafts for coupling the rotations thereof in common, to thereby effect counter-rotation of said shafts; and drive means comprised of a power source and a system of meshed gears arranged as a speed reducing system and adapted for connection to an end of said first shaft for driving said first shaft in rotation.

The objects and advantages of the present invention will become apparent from a consideration of the following detailed description when taken in conjunction with the accompanying drawing.

DESCRIPTION OF THE PREFERRED EMBODIMENT

Figure 1:
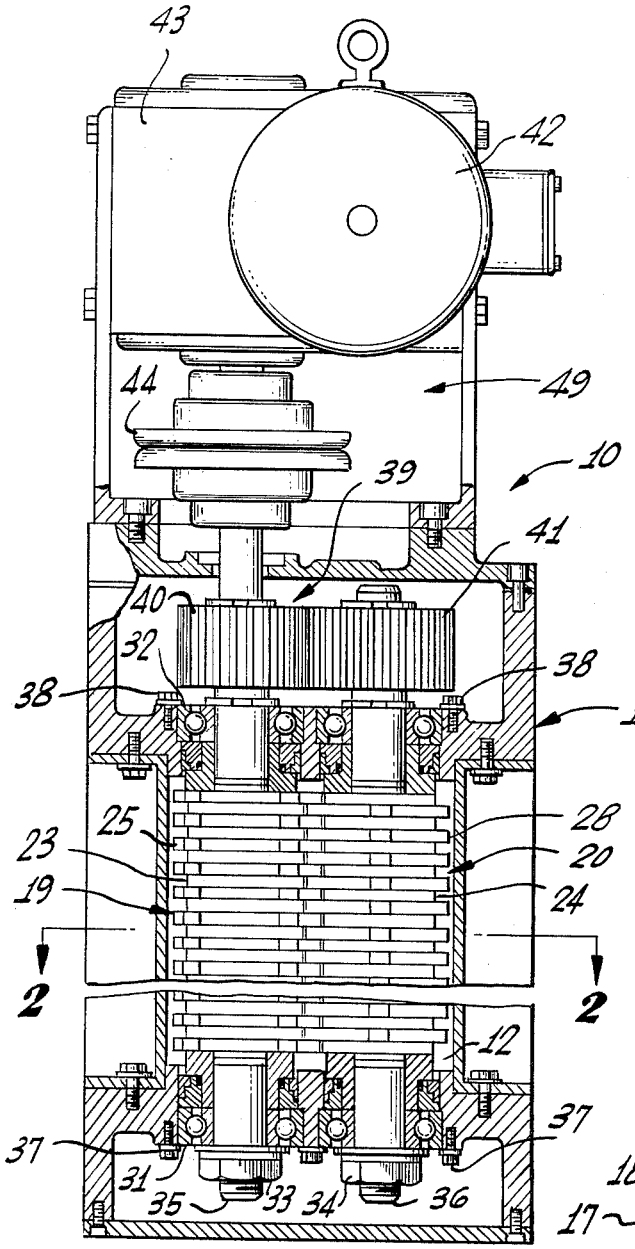
FIG. 1 is a sectional front elevational view of a comminutor apparatus for positioning in a sewage line.

With reference to the drawings, there is disclosed an apparatus 10 for comminuting solid waste material. This apparatus includes a casing designated generally at 11 which defines therein a comminution chamber 12. An inlet port 13 and an outlet port 14 provide a means for introduction and withdrawal respectively of solid waste material to and from the comminution chamber 12. As previously noted, in those instances where the waste line in which the apparatus 10 is to be used is an open channel rather than a closed conduit, the inlet and outlet ports will merely be access passageways. The inlet port 13 includes a flange ring 17 with a conventional pattern of bolt holes 18. Likewise, the outlet port 14 is equipped with a flange ring 15 through which are drilled bolt holes 16 in a common pattern. The inlet and outlet ports 13 and 14 with the perforated flanges 15 and 17 thereon allow the comminuting apparatus to be positioned in a conventional sewage or disposal conduit. Preferably, the inlet port 13 and the outlet port 14 are of a uniform diameter and have a common bolt hole pattern so that the comminuting apparatus 10 may be reversed in its disposition in a sewage conduit. That is, the port 14 could serve as an inlet port and the port 13 as an outlet port. First and second distally opposed bearing plates 31 and 32 are secured to casing 11 by means of bolts 37 and 38, respectively. Between the bearing plates 31 and 32 first and second shredding stacks 19 and 20 are respectively mounted in mutually parallel alignment. These stacks 19 and 20 are compressed between the opposing bearing plates 31 and 32 by means of nuts 33 and 34 which are respectively threadably engaged on shafts 35 and 36.

Figure 2:
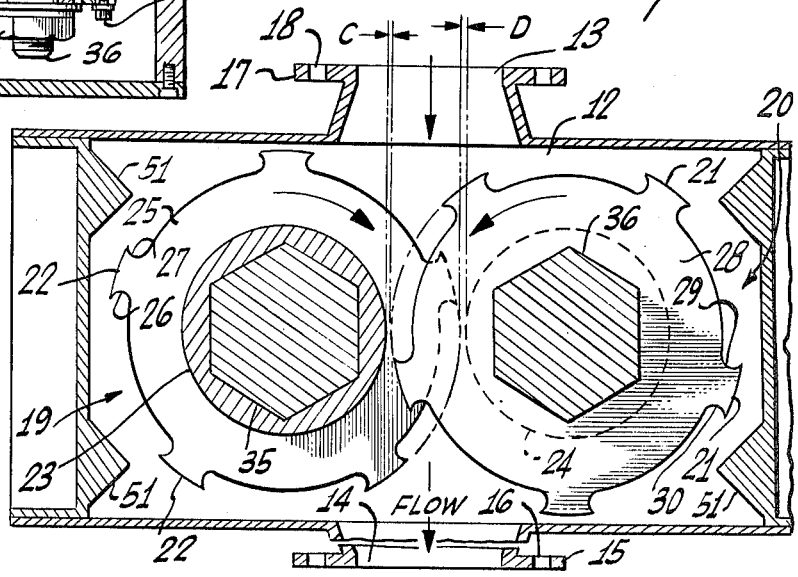
FIG. 2 is a sectional view of the apparatus of FIG. 1 taken along the lines 2—2 thereof.

Gearing means 39, comprised of gears 40 and 41, are disposed on adjacent ends of the shafts 35 and 36 for coupling the rotations of shafts 35 and 36 in common. This effects counter-rotation of the shafts 35 and 36 and stacks 19 and 20 as indicated in FIG. 2. The gears 40 and 41 are of different diameters so that the stacks 19 and 20 are rotated at different speeds thereby affecting a self-cleaning action between cutting elements.

A drive means is indicated generally at 49 and includes an electric motor 42 as a power source and a system of meshed gears, contained in gearbox 43, arranged as a speed reducing system is connected to an end of shaft 35 by means of the shock absorbing coupling 44. Shaft 35 is thereby driven in rotation, and in turn drives shaft 36 through gears 40 and 41. The power takeoff from motor 42 is through a conventional rotating drive shaft connected to the gear train in gearbox 43. The gearing system effects speed reduction of the motor drive shaft in a conventional manner and to an appropriate degree, for example, in a ratio of 50:1. This reduces the noise of the system and increases the efficiency of operation due to a significant increase in drive shaft torque. Preferably, the drive means 49 includes a reversing means for reversing the direction of rotation of the shaft 35 (and hence shaft 36). This reversing means may merely be a characteristic of the motor 42, if the motor 42 is of a type which can be operated in either direction or it may be rewired to run in reverse. Alternatively, an idler gear could be selectively moved into position in the gear train in order to reverse the direction of rotation of shaft 35. In this way, the shaft 35 can be driven in a direction opposite to that indicated in FIG. 2 if the comminutor 10 is reversed in its position in a sewage conduit with the port 14 becoming the inlet port, as previously described.

As previously indicated, each of the stacks 19 and 20 includes a number of laminar cutting elements. The cutting elements 25 are mounted on shaft 35 while cutting elements 28 are mounted concentrically on shaft 36. The cutting elements 25 and 28 are positioned between and separated in an axial direction along shafts 35 and 36 by laminar spacers 23 and 24, respectively. It should be noted that each of the laminar spacers is coplanar with a cutting element of the other stack, whereby a cutting element from one stack and a spacer from the other stack together form a pair of interactive shredding members. As is evident in FIG. 2, the spacer 23, visible on shaft 35, and the cutting element 28, visible on shaft 36, together form an interactive pair of shredding members. In the embodiment of the comminutor depicted, distance between the spacers and the teeth of the cutting elements differs as between different ones of the pairs of interacting shredding members. That is the clearance between the spacer 23 and the teeth 21 of cutting element 28 is the distance C. On the other hand, the minimum clearance between the spacer 24 and the teeth 22 is a greater distance D.

The provision of interacting shredding members in which the minimum distance of separation between a spacer and the teeth of a cutting element in different pairs of shredding members is advantageous for comminution functions in which shredding is the principal operation. This would include shredding of cardboard boxes, and the like. In the embodiment of the invention illustrated, the teeth 21 of the cutting element 28 are separated from the spacers 23 by a clearance distance C. The distance C may be from about 0.002 to about 0.010 inches (0.001 centimeters and 0.0254 centimeters). The teeth 22 of the cutting element 25, on the other hand, are separated from the spacers 24 by a clearance distance D. The distance D, for example, may be from about 0.005 to about 0.250 inches (0.0127 centimeters and 0.6250 centimeters).

As can be seen in FIG. 2, the central sections of shafts 35 and 36 within the corresponding stacks 19 and 20 are formed in a hexagonal cross section to provide a means for keying the spacers and cutting elements to their corresponding shaft, as each of the spacers and cutting elements has a central hexagonal bore therethrough.

From FIG. 2, it can also be seen that the cutting elements 25 and 28 are formed generally in the configuration of a disc with teeth extending radially through therefrom. Each tooth 21 on cutting elements 28 includes concave cutting surfaces 29 and 30 facing opposite rotational directions. Likewise, each tooth 22 on cutting elements 25 includes concave cutting surfaces 26 and 27 facing opposite rotational directions. Likewise, each tooth 22 on cutting elements 25 includes concave cutting surfaces 26 and 27 facing opposite rotational directions. Thus, the stacks 19 and 20 can be rotated within the comminution chamber 12 in the directions indicated in FIG. 2 whereupon shredding is effected principally at the cutting surfaces 27 and 29 of cutting elements 22 and 21 respectively. The side rails 51 within the comminuting chamber 12 serve to deflect solids into the cutting elements. The side rails serve to close in the comminuting chamber on in-line models, maintain a rigid and predetermined distance from the casing 11 and serve to deflect the flow of solids into the leading edges of the cutters (27, 29 if rotating, shown on FIG. 2).

A method of overload detection is preferably used whereby motor reversal is automatic whenever a material that cannot be comminuted for example hardened steel, or other metals becomes lodged between cutters. Detection is accomplished by monitoring and subsequently tripping the motor controller upon a sizeable increase in motor current. If the direction of rotation of each of the stacks 19 and 20 is reversed, shredding will occur at the shredding surfaces 26 and 30 of the teeth 22 and 21 respectively. This effectively nearly doubles the useful life of the cutting surfaces of the stacks 19 and 20, without increasing the dimensions thereof. All that is necessary is to reverse the direction of rotation of the shaft 35 to alternate the sets of cutting surfaces employed. When one set of cutting surfaces becomes worn, it may be desirable to reverse the position of the comminutor apparatus in the sewage line so that the port 14 becomes an inlet port and the port 13 becomes an outlet port. Normally this change is accompanied by a change in direction of rotation of the stacks 19 and 20.

In operation of the invention as illustrated, solid waste material may be entrained in a liquid and passed through the inlet port 13 in the cooperative intermeshed cutting elements and spacers of the stacks 19 and 20. The rotating stacks 19 and 20 quickly grind the solid waste material into fine particles which are carried in the entrained liquid through the outlet port 14.

It should be understood that the embodiment of the invention depicted is for purposes of illustration only, as numerous modifications and variations of the features illustrated will become readily apparent to those skilled in the art.

I claim:

1. Apparatus for comminuting solid waste material comprising:

a casing defining therein a comminution chamber with inlet and outlet ports thereto disposed on opposing sides of said comminution chamber and adapted for connection in a solid waste disposal line;

a comminutor assembly including cooperating substantially parallel first and second shredding stacks located in said comminution chamber and respectively having a plurality of first concentric laminar cutting elements mounted on a first shaft is interspaced relationship with a plurality of second laminar cutting elements mounted concentrically on a second shaft, each cutting element having teeth shaped for cutting in both of two opposite directions of rotation, and wherein the cutting elements of each stack are positioned between and separated in an axial direction by laminar spacers which are coplanar with the elements of the other stack whereby a cutting element from one shredder and a spacer from the other shredder form a pair of interactive shredding members, wherein the teeth of said cutting elements differ in their maximum radial dimensions, whereby the minimum clearance between the teeth of a cutting element and the opposing spacer within a pair of interactive shredding members differs as between different ones of said teeth, and wherein said first and second stacks are compressed between first and second distally opposed bearing plates which receive said first and second shafts, said bearing plates being secured to said casing in compression against said stacks;

means for securing said first and second bearing plates to said casing;

gearing means disposed on adjacent ends of said first and second shafts for coupling the rotations thereof in common, to thereby effect counter-rotation of said shafts; and drive means comprised of a power source and a system of meshed gears arranged as a speed reducing system and adapted for connection to an end of said first shaft for driving said first shaft in rotation.

2. The apparatus of claim 1 wherein the minimum clearance between a spacer and at least some of said teeth and a pair of shredding members is between about 0.002 and about 0.010 inches (0.0011 centimeters and 0.0254 centimeters) and the minimum clearance between others of said teeth in said same pair of shredding members is between about 0.005 and about 0.250 inches (0.0127 centimeters and 0.6250 centimeters).

3. An apparatus comminuting solid waste material and employing a casing defining a comminution chamber with inlet and outlet ports thereto, first and second comminution stacks secured to said casing in said comminution chamber and transversely positioned with respect to said inlet port and oriented substantially parallel to each other, each stack including cutting elements having radially extending teeth and spacer elements respectively arranged in cooperative intermeshed relationship with spacing elements and cutting elements likewise having radially extending teeth of the other comminution stack to form pairs of shredding members, the improvement comprising the provision of teeth shaped for cutting in both of two opposite directions of rotation and said inlet and outlet ports are positioned on opposing sides of said casing and designed for interchangeable connection to a solid waste disposal line.

4. The apparatus of claim 3 in which each cutting element in said pair of shredding members is formed generally in the configuration of a disc with teeth extending radially therefrom and each tooth includes concave cutting surfaces facing opposing rotational directions.

5. Apparatus for comminuting solid waste material comprising:

a casing defining therein a comminution chamber with inlet and outlet ports thereto disposed on opposing sides of said comminution chamber and adapted for connection in a solid waste disposal line;

a comminutor assembly including cooperating substantially parallel first and second shredding stacks located in said comminution chamber and respectively having a plurality of first concentric laminar cutting elements mounted on a first shaft in interspaced relationship with a plurality of second laminar cutting elements mounted concentrically on a second shaft, each cutting element having teeth shaped for cutting in both of two opposite directions of rotation, and wherein the cutting elements of each stack are positioned between and separated in an axial direction by laminar spacers which are coplanar with the elements of the other stack whereby a cutting element from one shredder and a spacer from the other shredder form a pair of interactive shredding members, wherein the minimum distance of separation between different ones of the teeth of a cutting element and the spacer associated therewith in a pair of shredding members differs as between at least some of said teeth of said cutting element, and wherein said first and second stacks are compressed between first and second distally opposed bearing plates which receive said first and second shafts, said bearing plates being secured to said casing in compression against said stacks;

means for securing said first and second bearing plates to said casing;

gearing means disposed on adjacent ends of said first and second shafts for coupling the rotations thereof in common, to thereby effect counter-rotation of said shafts; and drive means comprised of a power source and a system of meshed gears arranged as a speed reducing system and adapted for connection to an end of said first shaft for driving said first shaft in rotation.

6. Apparatus for comminuting solid waste material comprising:

a casing defining therein a comminution chamber with inlet and outlet ports thereto disposed on opposing sides of said comminution chamber and adapted for connection in a solid waste disposal line;

a comminutor assembly including cooperating substantially parallel first and second shredding stacks located in said comminution chamber and respectively having a plurality of first concentric laminar cutting elements mounted on a first shaft in interspaced relationship with a plurality of second laminar cutting elements mounted concentrically on a second shaft, each cutting element having teeth shaped for cutting in both of two opposite directions of rotation, and wherein the cutting elements of each stack are positioned between and separated in an axial direction by laminar spacers which are coplanar with the elements of the other stack whereby a cutting element from one shredder and a spacer from the other shredder form a pair of interactive shredding members, and wherein said first and second stacks are compressed between first and second distally opposed bearing plates which receive said first and second shafts, said bearing plates being secured to said casing in compression against said stacks;

means for securing said first and second bearing plates to said casing;

gearing means disposed on adjacent ends of said first and second shafts for coupling the rotations thereof in common, to thereby effect counter-rotation of said shafts; and drive means comprised of a power source, a system of meshed gears arranged as a speed reducing system and adapted for connection to an end of said first shaft for driving said first shaft in rotation, and reversing means for reversing the direction of rotation of said first shaft.

7. Apparatus for comminuting solid waste material comprising:

casing defining therein a comminution chamber with inlet and outlet ports thereto disposed on opposing sides of said comminution chamber and adapted for connection in a solid waste disposal line;

a comminutor assembly including cooperating substantially parallel first and second shredding stacks located in said comminution chamber and respectively having a plurality of first concentric laminar cutting elements mounted on a first shaft in interspaced relationship with a plurality of second laminar cutting elements mounted concentrically on a second shaft, each cutting element having teeth shaped for cutting in both of two opposite directions of rotation, and wherein the cutting elements of each stack are positioned between and separated in an axial direction by laminar spacers which are coplanar with the elements of the other stack whereby a cutting element from one shredder and a spacer from the other shredder form a pair of interactive shredding members, wherein the teeth of said cutting elements differ in their maximum radial dimensions, whereby the minimum clearance between the teeth of a cutting element and the opposing spacer within a pair of interactive shredding members differs as between different ones of said teeth, and wherein said first and second stacks are compressed between first and second distally opposed bearing plates which receive said first and second shafts, said bearing plates being secured to said casing in compression against said stacks;

means for securing said first and second bearing plates to said casing;

gearing means disposed on adjacent ends of said first and second shafts for coupling the rotations thereof in common, to thereby effect counter-rotation of said shafts; and drive means connected to an end of said first shaft for driving said first shaft in rotation.

8. Apparatus for comminuting solid waste material comprising:

a casing defining therein a comminution chamber with inlet and outlet ports thereto disposed on opposing sides of said comminution chamber;

a comminutor assembly including cooperating substantially parallel first and second shredding stacks located in said comminution chamber and respectively having a plurality of first concentric laminar cutting elements mounted on a first shaft in interspaced relationship with a plurality of second laminar cutting elements mounted concentrically on a second shaft, each cuttin element having teeth shaped for cutting in both of two opposite directions of rotation, and wherein the cutting elements of each stack are positioned between and separated in an axial direction by laminar spacers which are coplanar with the elements of the other stack whereby a cutting element from one shredder and a spacer from the other shredder form a pair of interactive shredding members, wherein the minimum distance of separation between different ones of the teeth of a cutting element and the spacer associated therewith in a pair of shredding members differs as between at least some of said teeth of said cutting element, and wherein said first and second stacks are compressed between first and second distally opposed bearing plates which receive said first and second shafts, said bearing plates being secured to said casing in compression against said stacks;

means for securing said first and second bearing plates to said casing;

gearing means disposed on adjacent ends of said first and second shafts for coupling the rotations thereof in common, to thereby effect counter-rotation of said shafts; and drive means connected to an end of said first shaft for driving said first shaft in rotation.

9. The apparatus of claim 8 wherein said drive means is comprised of a power source including a rotating drive shaft and a gear train effecting speed reduction of said drive shaft in a ratio of at least 30 to 1.

10. The apparatus of claim 9 wherein said gear train effects speed reduction of said drive shaft in a ratio of 50 to 1.

* * * * *